US008672691B2

(12) United States Patent
Kondo

(10) Patent No.: US 8,672,691 B2
(45) Date of Patent: Mar. 18, 2014

(54) CONNECTOR

(75) Inventor: Hayato Kondo, Yao (JP)

(73) Assignee: Hosiden Corporation, Yao-Shi (JP)

( * ) Notice: Subject to any disclaimer, the term of this patent is extended or adjusted under 35 U.S.C. 154(b) by 34 days.

(21) Appl. No.: 13/428,119

(22) Filed: Mar. 23, 2012

(65) Prior Publication Data

US 2012/0270445 A1 Oct. 25, 2012

(30) Foreign Application Priority Data

Apr. 20, 2011 (JP) ..... 2011-094396

(51) Int. Cl.
*H01R 13/648* (2006.01)

(52) U.S. Cl.
USPC ..... 439/108

(58) Field of Classification Search
USPC ..... 439/607.35, 941, 638, 660, 108, 101
See application file for complete search history.

(56) References Cited

U.S. PATENT DOCUMENTS

| | | | | |
|---|---|---|---|---|
| 6,461,194 | B2 * | 10/2002 | Katoh et al. | 439/607.05 |
| 6,540,559 | B1 * | 4/2003 | Kemmick et al. | 439/607.05 |
| 6,575,789 | B2 * | 6/2003 | Bassler et al. | 439/607.23 |
| 6,863,549 | B2 * | 3/2005 | Brunker et al. | 439/108 |
| 6,969,268 | B2 * | 11/2005 | Brunker et al. | 439/108 |
| 7,165,981 | B2 * | 1/2007 | Bassler et al. | 439/101 |
| 7,448,884 | B2 * | 11/2008 | Kato et al. | 439/108 |
| 7,722,407 | B2 * | 5/2010 | Momose | 439/638 |
| 7,837,492 | B2 * | 11/2010 | Zhu | 439/329 |
| 7,997,937 | B2 * | 8/2011 | Kondo | 439/660 |
| 8,376,785 | B2 * | 2/2013 | Lapidot et al. | 439/660 |
| 8,419,457 | B2 * | 4/2013 | Lee et al. | 439/326 |
| 2003/0064626 | A1 * | 4/2003 | Kemmick et al. | 439/609 |

FOREIGN PATENT DOCUMENTS

| | | |
|---|---|---|
| JP | 7-161414 | 6/1995 |
| WO | WO 2008/002376 | 1/2008 |

OTHER PUBLICATIONS

Extended European Search Report received in counterpart application No. 12002308.0-1231 mailed Jul. 26, 2012 (7 pages).

* cited by examiner

*Primary Examiner* — Alexander Gilman
(74) *Attorney, Agent, or Firm* — Kratz, Quintos & Hanson, LLP

(57) ABSTRACT

The invention provides a connector including a body having insulation properties and a terminal group arranged in a row in a first direction of the body. The terminal group includes a pair of first signal terminals, a second signal terminal, and a ground terminal. The first signal terminals extend in a second direction and are adjacent to each other in the first direction. The second signal terminal extends in the second direction. The ground terminal extends in the second direction and is disposed between one of the first signal terminals and the second signal terminal. A widthwise dimension in the first direction of the ground terminal is less than twice that of each of the first signal terminals. A thicknesswise dimension of at least a part of the ground terminal in a third direction is larger than that of each of the first and second signal terminals.

20 Claims, 6 Drawing Sheets

CONNECTOR

The present application claims priority under 35 U.S.C. §119 of Japanese Patent Application No. 2011-094396 filed on Apr. 20, 2011, the disclosure of which is expressly incorporated by reference herein in its entity.

BACKGROUND OF THE INVENTION

1. Technical Field

The present invention relates to a connector including signal terminals and a ground terminal.

2. Background Art

There is known a conventional connector having a plurality of terminals arrayed in a plurality of rows, as disclosed in Japanese Unexamined Patent Publication No. H07-161414. The terminals include signal terminals and ground terminals. In each of the rows, the signal terminals and the ground terminals are arrayed alternately. It is also known that crosstalk of high-frequency signals transmitted to the signal terminals may be reduced by setting a dimension in an array direction of each ground terminal as equal to or larger than twice that of each signal terminal (see FIG. 3 of H07-161414). The array direction herein refers to an array direction of the terminals in each row.

SUMMARY OF INVENTION

However, setting the dimension in an array direction of each ground terminal as equal to or larger than twice that of each signal terminal will result in a increased dimension in the array direction of the connector.

In light of the above situation, the invention is devised to provide a connector that can suppress crosstalk and has a reduced dimension in an array direction of terminals.

A first connector of the present invention includes a body having insulation properties; and a terminal group arranged in a row in a first direction of the body. The terminal group includes a pair of first signal terminals, a second signal terminal, and a ground terminal. The pair of first signal terminals extends in a second direction orthogonal to the first direction and are adjacent to each other in the first direction. The second signal terminal extends in the second direction. The ground terminal extends in the second direction and is disposed between one of the first signal terminals and the second signal terminal. A widthwise dimension in the first direction of the ground terminal is less than twice that of each of the first signal terminals. A thicknesswise dimension of at least a part of the ground terminal in a third direction orthogonal to the first and second directions is larger than that of each of the first and second signal terminals.

In the first connector, the ground terminal has a widthwise dimension in the first direction less than twice that of each of the first signal terminals, while at least a part of the ground terminal has a thicknesswise dimension in the third direction larger than that of each of the first and second signal terminals, which configuration can decrease a conductor resistance and a ground potential of the ground terminal. Consequently, the ground terminal of the first connector can suppress crosstalk between signals transmitted by the first signal terminals and signals transmitted by the second signal terminal, and it is possible to reduce the widthwise dimension in the first direction of the first connector.

The second terminal of the terminal group may comprise a pair of second signal terminals adjacent to each other in the first direction. The ground terminal may be disposed between the one first signal terminal and one of the second signal terminals.

The ground terminal may comprise a plurality of ground terminals arranged in spaced relation to each other along the first direction. The pair of first signal terminals may be interposed between adjacent two of the ground terminals. The pair of second signal terminals may be interposed between another adjacent two of the ground terminals.

According to this aspect of the invention, as the pair of first signal terminals are interposed between adjacent two of the ground terminals and the pair of second signal terminals are interposed between another adjacent two of the ground terminals, the ground terminals function as shield walls against electric field leakage from the first and second signal terminals, improving electromagnetic interference (EMI) characteristics of the first connector. Moreover, this arrangement of the ground terminals contributes to matched impedances between the pair of first signal terminals and between the pair of second signal terminals. Thus, this aspect of the invention can improve transmission characteristics of the first and second signal terminals.

It is preferable that a center of a cross-section in the third direction of said part of the ground terminal be located substantially at the same height in the third direction as centers of cross-sections in the third direction of portions of the first and second signal terminals corresponding to said part of the ground terminal. This aspect of the invention contributes to better matched impedances between the pair of first signal terminals and between the pair of second signal terminals. Thus, it is possible to further improve the transmission characteristics of the first and second signal terminals.

The widthwise dimension in the first direction of the ground terminal may be smaller than the widthwise dimension in the first direction of at least one of the first and second signal terminals. According to this aspect of the invention, the ground terminal having a smaller widthwise dimension than at least one of the first and second signal terminals contributes to the reduction in the widthwise dimension in the first direction of the first connector.

Alternatively, the ground terminal may have a generally identical outer shape, except its thicknesswise dimension, to that of at least one of the first and second signal terminals. According to this aspect of the invention, the ground terminal and at least one of the first and second signal terminals can be created by pressing electrically conductive plates with different thicknesses with the same die, thus reducing the manufacturing cost of the first connector.

The first and second signal terminals may be electrically conductive plates extending not only in the second direction but also in the first direction. The ground terminal may be a electrically conductive plate extending not only in the second direction but also in the third direction. According to this aspect of the invention, the first and second signal terminals are electrically conductive plates extending in the first and second directions, while the ground terminal is a electrically conductive plate extending in the second and third directions, so that the ground terminal may function as a high shield wall against electric field leakage from the first and second signal terminals. Thus, the first connector has improved EMI characteristics.

It is preferable that the thicknesswise dimension in the third direction of at least said part of the ground terminal may be equal to or larger than 1.5 times that of each of the first and second signal terminals.

A second connector of the present invention includes a body having insulation properties and a terminal group. The terminal group includes a plurality of signal terminals and a ground terminal. The signal terminals and the ground terminal are arrayed in a row along a first direction in the body. The signal terminals extend in a second direction orthogonal to the first direction. The ground terminal extends in the second direction and is disposed between two adjacent ones of the signal terminals. A widthwise dimension in the first direction of the ground terminal is less than twice that of each of the signal terminals. A thicknesswise dimension of at least a part of the ground terminal in a third direction orthogonal to the first and second directions is larger than that of each of the signal terminals.

In the second connector, the ground terminal has a widthwise dimension in the first direction less than twice that of each signal terminal, while at least a part of the ground terminal has a thicknesswise dimension in the third direction larger than that of each signal terminal, which configuration can decrease a conductor resistance and a ground potential of the ground terminal. Consequently, the ground terminal of the second connector can suppress crosstalk between signals transmitted by the signal terminals, and it is possible to reduce the widthwise dimension in the first direction of the second connector.

The ground terminal may include a plurality of ground terminals arranged in spaced relation to each other along the first direction. The signal terminals may be each interposed between adjacent two of the ground terminals.

According to this aspect of the invention, as the signal terminals are each interposed between adjacent two of the ground terminals, the ground terminals function as shield walls against electric field leakage from the signal terminals, thus improving electromagnetic interference (EMI) characteristics of the second connector. Moreover, the ground terminals exist on opposite sides of each signal terminal, which arrangement contributes to matched impedances between all the signal terminals. Thus, this aspect of the invention can improve transmission characteristics of all the signal terminals.

A center of a cross-section in the third direction of said part of the ground terminal may be located substantially at the same height in the third direction as centers of cross-sections in the third direction of portions of the signal terminals corresponding to said part of the ground terminal. This aspect of the invention contributes to better matched impedances between the signal terminals and the improved transmission characteristics of the signal terminals.

The widthwise dimension in the first direction of the ground terminal may be smaller than that of each of the signal terminals. According to this aspect of the invention, the ground terminal having a smaller widthwise dimension than at least one of the signal terminals contributes to the reduction in the widthwise dimension in the first direction of the second connector.

The ground terminal may have a generally identical outer shape, except the thicknesswise dimension thereof, to that of each of the signal terminals. According to this aspect of the invention, the ground terminal and the signal terminals can be created by pressing electrically conductive plates with different thicknesses using the same die, thus reducing the manufacturing cost of the second connector.

The signal terminals may be electrically conductive plates extending not only in the second direction but also in the first direction. The ground terminal may be an electrically conductive plate extending not only in the second direction but also in the third direction. According to this aspect of the invention, the signal terminals are electrically conductive plates extending in the first and second directions, while the ground terminal is a electrically conductive plate extending in the second and third directions, so that the ground terminal may function as a high shield wall against electric field leakage from the signal terminals. Thus, the second connector has improved EMI characteristics.

It is preferable that the thicknesswise dimension in the third direction of at least said part of the ground terminal be equal to or larger than 1.5 times that of each of the signal terminals.

DESCRIPTION OF EMBODIMENTS

Figure 1:
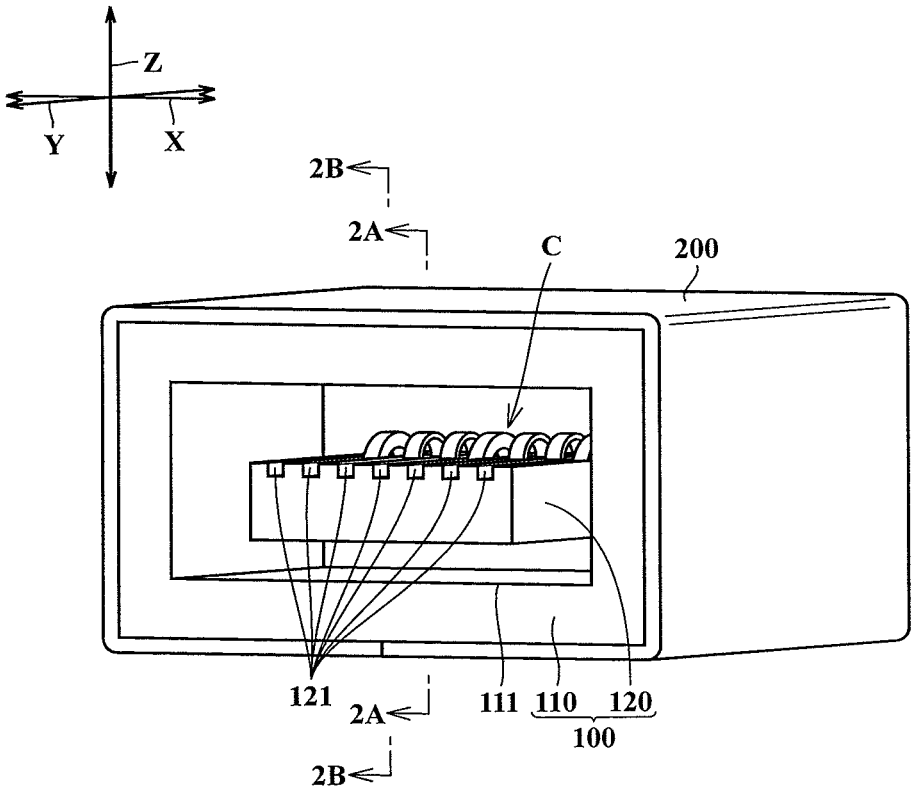
FIG. 1 is a diagrammatic front, top and right side perspective view of a connector according to an embodiment of the present invention.

A connector according to an embodiment of the present invention will be described below referring to FIGS. 1 to 4. The connector shown in FIG. 1 is a receptacle connector mountable on a circuit board (not shown) and connectable with a plug connector (not shown). The connector includes a body 100, a shell 200, and a terminal group C. Respective components of the connector will be described in detail below. It should be noted that FIGS. 1 to 4 indicate directions X, Y, and Z, where the X is a first direction, which is a widthwise direction of the connector and an array direction of the terminal group C; the Y is a second direction, which is a front-back direction of the connector and is orthogonal to the first direction X; and the Z is a third direction, which is a top-bottom direction of the connector and is orthogonal to the first and second directions X and Y.

The body 100 of rectangular parallelepiped shape is made of insulating resin. The body 100 has a main body 110 and a projection 120, as shown in FIGS. 1 and 2. The front surface in the second direction Y of the main body 110 has a substantially rectangular reception hole 111 for removably receiving a plug connector. The projection 120 extends from a backside surface in the second direction Y of the reception hole 111. The projection 120 is a rectangular plate extending in the first direction X and the second direction Y. An upper surface of the projection 120 is formed with a plurality of grooves 121 extending in the second direction Y.

Figure 2A:
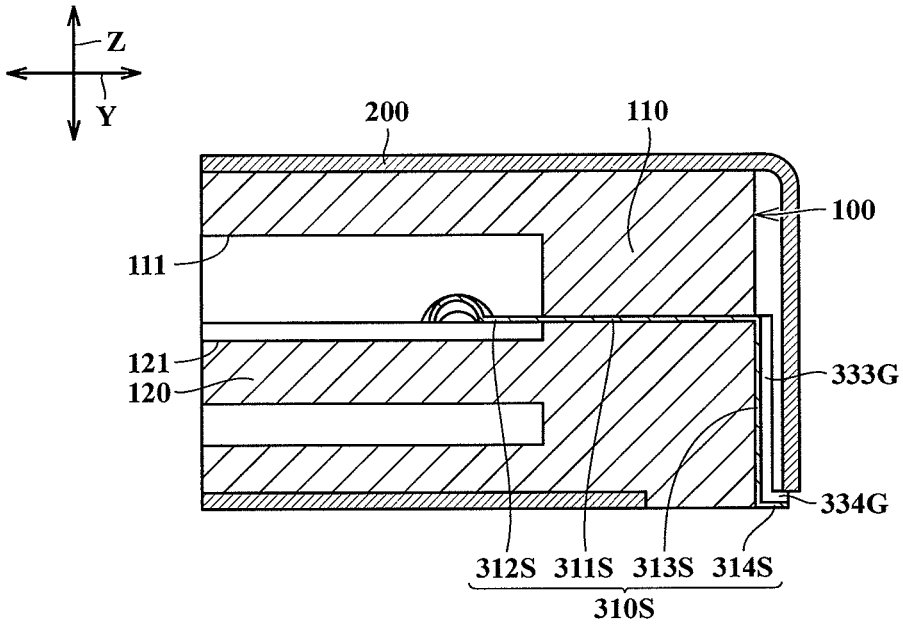
FIG. 2A is a cross-sectional view of the connector, taken along 2A-2A in FIG. 1.
Figure 2B:
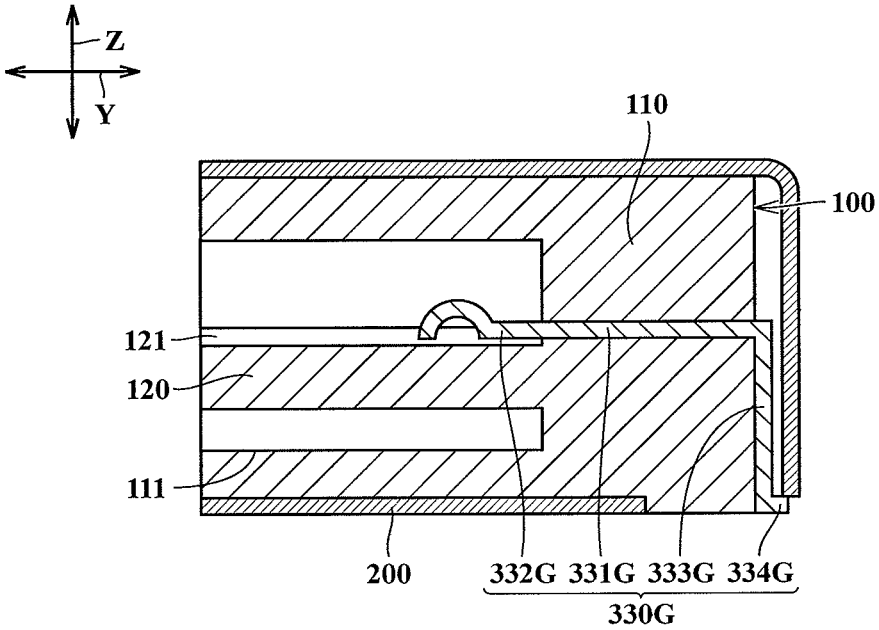
FIG. 2B is a cross-sectional view of the connector, taken along 2B-2B in FIG. 1.

The shell 200 is a rectangular tube made of an electrically conductive metal plate, covering the outer peripheral surface of the body 100, as shown in FIG. 1 and FIGS. 2A, 2B.

The terminal group C includes a pair of first signal terminals 310S, a pair of second signal terminals 320S, and a plurality of ground terminals 330G, as shown in FIGS. 1 to 4. In the terminal group C, the first and second signal terminals and the ground terminals are arrayed in a row along the first direction X inside the body 100 in an order of 330G, 310S, 310S, 330G, 320S, 320S, and 330G (i.e., the terminal group C is arrayed in a row along the first direction X inside the body 100).

Figure 3:
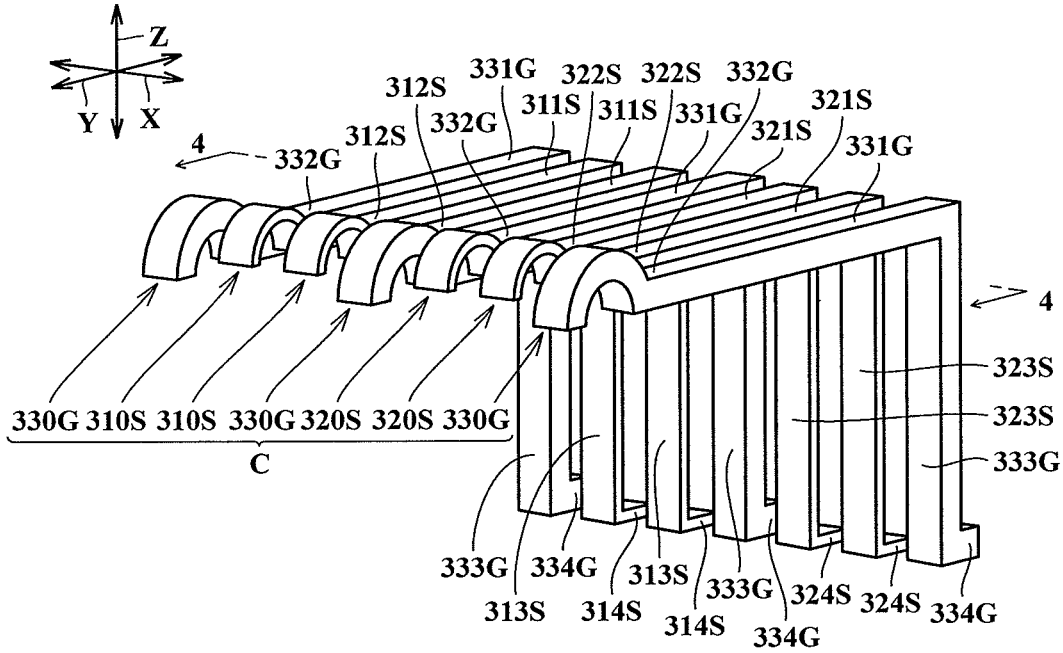
FIG. 3 is a diagrammatic front, top and right side perspective view of first and second signal terminals and ground terminals of the connector.

As shown in FIGS. 2A and 3, the pair of first signal terminals 310S are next to each other in the first direction X to form a differential pair for transmission of high-speed differential signals of 1 GHz or higher. The first signal terminals 310S are electrically conductive metal plates extending in the second direction Y. Each of the first signal terminals 310S has an intermediate portion 311S, a contact portion 312S, a bent portion 313S, and a tail portion 314S.

The intermediate portion 311S is a plate extending in the second direction Y, and it is embedded in and held by the main body 110 of the body 100. The intermediate portion 311S has a first end and a second end in the second direction Y, and the contact portion 312S is provided continuously to the first end and the bent portion 313S is provided continuously to the second end.

The contact portion 312S is a plate extending in the second direction Y continuously to the intermediate portion 311S. The contact portion 312S is received in each of the grooves 121 of the projection 120 of the body 100. The contact portion 312S has a curved portion of a circular arc shape that is curved upwardly in the third direction Z. The curved portion is contactable with each signal contact of the above-mentioned plug.

The bent portion 313S is a substantially L-shaped plate bent at a right angle to the intermediate portion 311S, and it extends in the third direction Z along a rear surface in the second direction Y of the main body 110. The tail portion 314S is a plate provided continuously to a lower end in the third direction Z of the bent portion 313S and bent at a right angle to the bent portion 313S to extend in the second direction Y. The tail portion 314S is connectable to each signal line of the circuit board.

As shown in FIG. 3, the pair of second signal terminals 320S are next to each other in the first direction X to form a differential pair for transmission of high-speed differential signals of 1 GHz or higher. The second signal terminals 320S are electrically conductive metal plates extending in the second direction Y, and they have the same configuration as the first signal terminals 310S. The second signal terminals 320S each have an intermediate portion 321S, a contact portion 322S, a bent portion 323S, and a tail portion 324S. The respective portions of the second signal terminal 320S will not be described further in detail to avoid redundancy with the description of the first signal terminal 310S.

Figure 4:
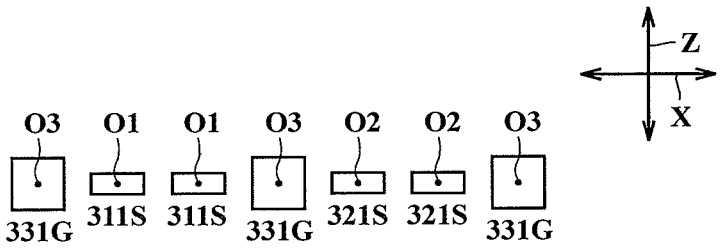
FIG. 4 is a schematic end view of the cross-section along 4-4 in FIG. 3 of the first and second signal terminals and the ground terminals.

As shown in FIGS. 2B and 3, the ground terminals 330G are electrically conductive metal plates extending in the second direction Y. They each have the substantially same outer shape, except its thicknesswise dimension, as each outer shape of the first and second signal terminals 310S, 320S. The ground terminals 330G each have the same dimension in the first direction X as each of the first and second signal terminals 310S, 320S. As shown in FIGS. 3 and 4, the thicknesswise dimension (plate thickness) of each ground terminal 330G is larger than or equal to 1.5 times that of each of the first and second signal terminals 310S, 320S. One of the ground terminals 330G is disposed between one of the paired first signal terminals 310S and one of the paired second signal terminals 320S; another ground terminal 330G is disposed on a side (outer side) of the opposite sides of the other first signal terminal 310S, the side being opposite from said one of the first signal terminals 310S; and the other ground terminal 330G is disposed on a side (outer side) of opposite sides of the other second signal terminal 320S, the side being opposite from said one of the second signal terminals 320S. In other words, the ground terminals 330G are arrayed in the first direction; the pair of first signal terminals 310S are each interposed between adjacent two of the ground terminals 330G; and the pair of second signal terminals 320S are each interposed between another adjacent two of the ground terminals 330G.

The ground terminals 330G each have an intermediate portion 331G, a contact portion 332G, a bent portion 333G, and a tail portion 334G. The intermediate portion 331G is a plate extending in the second direction Y, and it is embedded in and held by the main body 110 of the body 100. The thicknesswise dimension in the third direction Z (plate thickness) of each intermediate portion 331G is larger or equal to 1.5 times that of each intermediate portion 311S, 321S of the first and second signal terminals 310S, 320S. FIG. 4 illustrates centers O3 of cross-sections in the third direction Z of the intermediate portions 331G (each intermediate portion 331G being a part of the portion where the thicknesswise dimension of each ground terminal is larger than that of each of the first and second signal terminals). FIG. 4 also illustrates centers O1, O2 of cross-sections in the third direction Z of the intermediate portions 311S, 321S, respectively (i.e., portions of the first and second signal terminals corresponding to the above-mentioned part). It will be appreciated that the centers O3 are located substantially at the same height in the third direction Z as the centers O1, O2. Each intermediate portion 331G has first and second ends in the second direction Y, and the contact portion 332G is provided continuously to the first end, and the bent portion 333G is provided continuously to the second end.

The contact portion 332G is a plate extending in the second direction Y continuously from the intermediate portion 331G. The thicknesswise dimension in the third direction Z (plate thickness) of the contact portion 332G is larger than or equal to 1.5 times that of each of the contact portions 312S, 322S of the first and signal terminals 310S, 320S. The contact portion 332G is received in each of the grooves 121 in the projection 120 of the body 100. The contact portion 332G has a curved portion in a circular arc shape that is curved upwardly in the third direction Z. The curved portion is contactable with a ground contact of the above-mentioned plug.

The bent portion 333G is a substantially L-shaped plate bent at a right angle to the intermediate portion 331G to extend in the third direction Z along the rear surface in the second direction Y of the main body 110. The thicknesswise dimension in the second direction Y (plate thickness) of the bent portion 333G is larger than or equal to 1.5 times that of each of the bent portions 313S, 323S of the first and signal terminals 310S, 320S.

The tail portion 334G is a plate provided continuously to a lower end in the third direction Z of the bent portion 333G and bent at a right angle to the bent portion 333G to extend in the second direction Y. A thicknesswise dimension in the third direction Z (plate thickness) of the tail portion 334G is larger than or equal to 1.5 times that of each of the tail portions 314S, 324S of the first and signal terminals 310S, 320S. The tail portion 314S is contactable with a ground line of the circuit board.

The connector may be configured as described above and may be manufactured in the following manner. First, a first metal plate having electrical conductivity is prepared. The metal plate is then pressed, using a predetermined stamping die to form the first and second signal terminals 310S, 320S. Also is prepared a second metal plate having electrical conductivity of a plate thickness larger than or equal to 1.5 times that of the first metal plate. The second metal plate is then pressed, using the same die to form the ground terminals 330G.

Thereafter, the body 100 is formed by injection-molding insulating resin. When the body 100 is formed, the intermediate portions 311S of the first signal terminals 310S, the intermediate portions 321S of the second signal terminals 320S, and the intermediate portions 331G of the ground terminals 330G are inserted in the main body 110, i.e. the intermediate portions 311S, 311S, 331G are embedded in and held by the main body 110 of the body 100. As a result, the first and second signal terminals and the ground terminals are arrayed in a row along the first direction X inside the body 100 in the order of 330G, 310S, 310S, 330G, 320S, 320S, and 330G. The contact portions 312S of the first signal terminals 310S, the contact portions 322S of the second signal terminals 320S, and the contact portions 332G of the ground terminals 330G are received in the grooves 121 of the projection 120 of the body 100.

The body 100 is then inserted into the shell 200. The connector is now finished and ready to be mounted on the circuit board. At this time, the shell 200 is connected to the ground line of the circuit board, the tail portions 314S, 324S are connected to the signal lines of the circuit board, and the tail portions 334G are connected to the ground line of the circuit board by soldering.

In the above-described connector, the ground terminals 330G each have the same dimension in the first direction X as each of the first and second signal terminals 310S, 320S, while the ground terminals 330G each have a thicknesswise dimension (plate thickness) equal to or larger than 1.5 times that of each of the first and second signal terminals 310S, 320S. Accordingly, each ground terminal 330G is advantageously reduced in conductor resistance and ground potential. The connector, having one of the ground terminals 330G disposed between the pair of first signal terminals 310S and the pair of second signal terminals 320S, is able to reduce crosstalk between signals transmitted by the first signal terminals 310S and signals transmitted by the second signal terminals 320S. Further advantageously, the connector has a reduced widthwise dimension in the first direction because the ground terminals 330G each have the same dimension in the first direction X as each of the first and second signal terminals 310S, 320S.

Furthermore, the ground terminals 330G each have a larger plate thickness than each of the first signal terminals 310S and the second signal terminals 320S, and they are located on the opposite sides of the first signal terminals 310S and on the opposite sides of the second signal terminals 320S. As such, the ground terminals 330G function as shield walls against electric field leakage from the first and second signal terminals 310S, 320S. The connector is therefore advantageous in improving electromagnetic interference (EMI) characteristics. It should also be noted that the ground terminals 330G are located on the opposite sides of the first signal terminals 310S and on the opposite sides of the second signal terminals 320S, and the centers O3 of the intermediate portions 331G of the ground terminals 330G are located substantially at the same height in the third direction Z as the centers O1, O2 of the intermediate portions 311S, 321S of the first and second signal terminals 310S, 320S. This arrangement of terminals is advantageous in matching impedances between the first signal terminals 310S and the second signal terminals 320S and improving transmission characteristics of the first and second signal terminals 310S, 320S.

The connector of the invention is not limited to the above-described embodiment, but it may be modified within a scope described in the claims. Design variations of the invention will be described in detail below by way of example.

The first and second signal terminals of the invention are not limited to the case according to above-described embodiment, wherein the first and second signal terminals 310S, 320S have the same shape. For example, the first signal contacts may have different shapes from those of the second signal terminals. Alternatively, one of the first signal terminals and one of the second signal terminals may have the same shape to each other but different from those of the other first signal terminal and the other second signal terminal. Further alternatively, one and the other of the first signal terminals and one and the other of the second signal terminals may have different shapes from each other.

Figure 5:
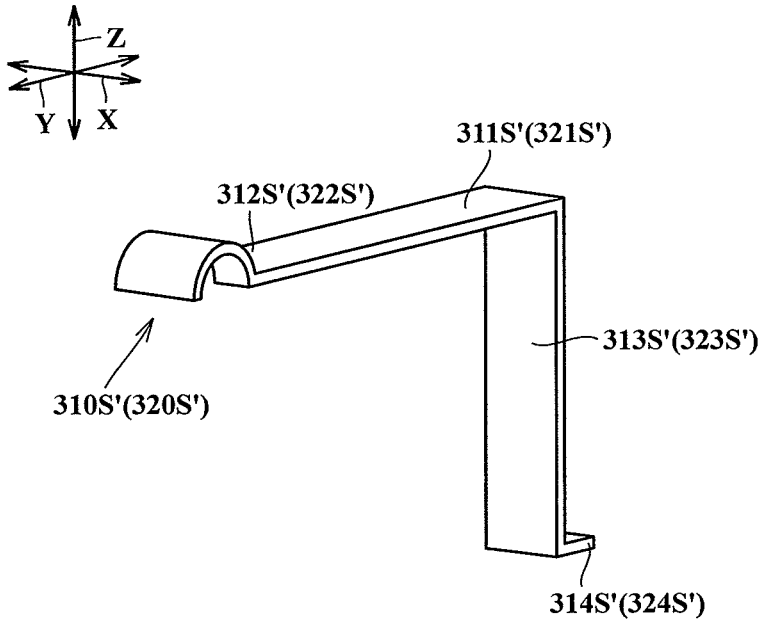
FIG. 5 is a diagrammatic perspective view of a variant of the first and second signal terminals.

The first and second signal terminals of the invention may be configured like the first and second signal terminals 310S, 320S of the above-described embodiment, having the intermediate portions 311S, 321S, the contact portions 312S, 322S, the bent portions 313S, 323S and the tail portions 314S, 324S. However, the first and second signal terminals may have any other configurations as long as they are at least electrically conductive members extending in the second direction. For example, the first and second signal terminals may be straight in shape and extend in the second direction. An alternative modification is illustrated in FIG. 5, where first and second signal terminals 310S', 320S' are electrically conductive plates generally extending in the first direction X and the second direction Y. In this case, intermediate portions 311S', 321S', contact portions 312S', 322S', and tail portions 314S', 324S' are plates extending in the first direction X and the second direction Y. The bent portions 313S', 323S' are substantially L-shaped plates bent at a right angle to the intermediate portions 311S', 321S' and extending in the first direction X and the third direction Z.

The ground terminal of the invention may be configured like the ground terminals 330G of the above-described embodiment, wherein each ground terminal 330G has the intermediate portion 331G, the contact portion 332G, the bent portion 333G, and the tail portion 334G, and it has the substantially identical outer shape, except its thicknesswise dimension, to those of the first and second signal terminals 310S, 320S. The ground terminal may be modified in any manner on the following conditions. A first condition is that the ground terminal is an electrically conductive member extending in the second direction. A second condition is that the ground terminal has a widthwise dimension in the first direction smaller than twice that of each of the first signal terminals. A third condition is that the ground terminal, at least a portion thereof, has a larger thicknesswise dimension in the third direction than each of the first and second signal terminals. As to the third condition, it is preferable that the ground terminal, at least a portion thereof, has a thicknesswise dimension in the third direction equal to or larger than 1.5 times that of each of the first and second signal terminals at portions corresponding to the said portion of the ground terminal.

Figure 6:
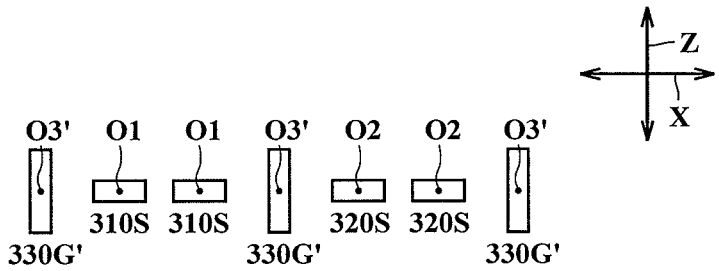
FIG. 6 is a schematic end view of a cross-section of the first and second signal terminals and the ground terminals for describing a design modification of the ground terminals.

In the case where the first signal terminals and the second signal terminals have different shapes, in the case where one of the first signal terminals and one of the second signal terminals have the same shape to each other but different from the other first signal terminal and the other second signal terminal, respectively, or in the case where all the first and second signal terminals have different shapes from each other, the ground terminal may have substantially the same outer shape, except its thicknesswise dimension, as that of at least one of the first signal terminals, or at least one of the second signal terminals. An alternative modification is illustrated in FIG. 6, wherein each ground terminals 330G' has a smaller widthwise dimension in the first direction X than each of the first and second signal terminals 310S, 320S. Further alternatively, the ground terminal may have a smaller widthwise dimension in the first direction X than each first signal terminal only or than each second signal terminal only. FIG. 6 shows a center O3', which is the center of a cross-section in the third direction Z of each ground terminals 330G'.

Figure 7:
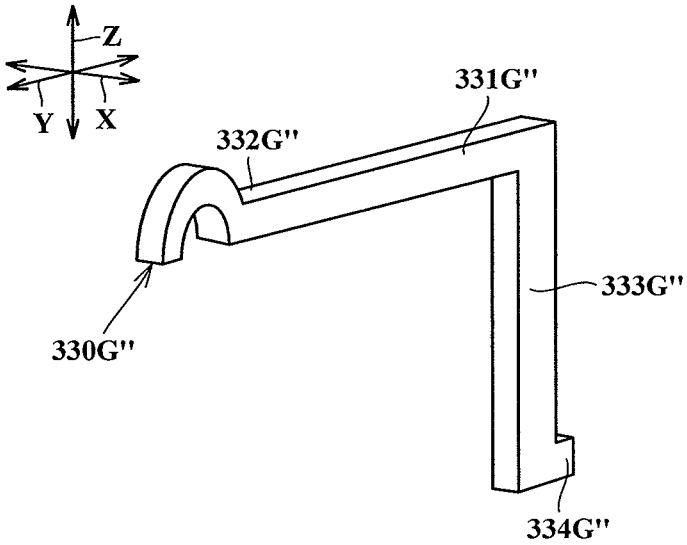
FIG. 7 is a diagrammatic perspective view showing another design modification of the ground terminal.

Moreover, in the case where the ground terminal and the first and second signal terminals are straight in shape and extend in the second direction or the like, the ground terminal may have a larger thicknesswise dimension in the third direction from end to end than each of the first and second signal terminals. Alternatively, the ground terminal may have a larger thicknesswise dimension in the third direction at its intermediate portion than each of the first and second signal terminals. An alternative modification is illustrated in FIG. 7, wherein a ground terminal 330G" is an electrically conductive plate generally extending in the second direction Y and the third direction Z. In this case, an intermediate portion 331G", a contact portion 332G", a bent portion 333G", and a tail portion 334G" are plates extending in the second direction Y and the third direction Z. The ground terminal 330G" may be disposed between one of the first signal terminals 310S and one of the second signal terminals 320S, or between one of the first signal terminals 310S' and one of the second signal terminals 320S'. Moreover, additional ground terminals 330G" may be provided, one on a side of the two sides of the other first signal terminal 310S or 310S', the side being opposite from said one of the first signal terminals 310S or 310S', and another ground terminal 330G" on a side of the two sides of the other second signal terminal 320S or 320S', the side being opposite from said one of the second signal terminal 320S or 320S'. In other words, the first signal terminals 310S may each be disposed between adjacent two of the ground terminals 330G"; the second signal terminals 320S may each be disposed between adjacent two of the ground terminals 330G"; the first signal terminals 310S' may each be disposed between adjacent two of the ground terminals 330G"; and the second signal terminals 320S' may each be disposed between adjacent two of the ground terminals 330G".

The height positions of the terminals are not limited to those of the above-described embodiment, wherein the centers O3 of the intermediate portions 331G of the ground terminals 330G are located substantially at the same height in the third direction Z as the centers O1, O2 of the intermediate portions 311S, 321S of the first and second signal terminals 310S, 320S. Alternatively, the center of the cross-section in the third direction of the portion (part) of each ground terminal, which portion is of larger thicknesswise dimension in the third direction than each of the first and second signal terminals, is located at substantially the same height position as the center of the cross-section in the third direction of the portion of each of the first and second signal terminals corresponding to the said part of each ground terminal. In other words, the height positions of the centers of cross-sections in the third direction may be aligned at other portions than the intermediated portions of the ground terminals and the first and second signal terminals. Alternatively, the centers of cross-sections in the third direction of the said parts of the ground terminals and the centers of cross-sections in the third direction of the portions of the first and second signal terminals corresponding to the said parts of the ground terminals may be located at different height positions.

The body may be formed by insert molding with the intermediate portions of the first and second signal terminals and the ground terminals inserted therein as in the above embodiment. Any design modification may be made as long as the terminals are held in the body and arrayed at least in one row. For example, the body may be formed with through-holes extending in the second direction Y, which may receive the intermediate portions of the first and second signal terminals and the ground terminals.

The ground terminals according to the above embodiment and design modifications may be arranged such that one is disposed between one of the pair of first signal terminals and one of the pair of second signal terminals, another on one of the opposite sides of the other first signal terminal that is opposite from the one of the first signal terminals, and the other on one of the opposite sides of the other second signal terminal that is opposite from the one of the second signal terminals. The ground terminals may be disposed at any other positions, each between two adjacent signal terminals. For example, there may be a single ground terminal disposed between one of the pair of first signal terminals and one of the pair of second signal terminals. Alternatively, a ground terminal may be disposed between the one of the first signal terminals and a different signal terminal (which may be a second signal terminal). In other words, a ground terminal may be disposed between a terminal of a differential pair and a signal terminal of other kind. In any of the above arrangements, the first and second signal terminals and the ground terminal are arrayed in a row in the first direction as in the above-described embodiment.

Figure 8A:
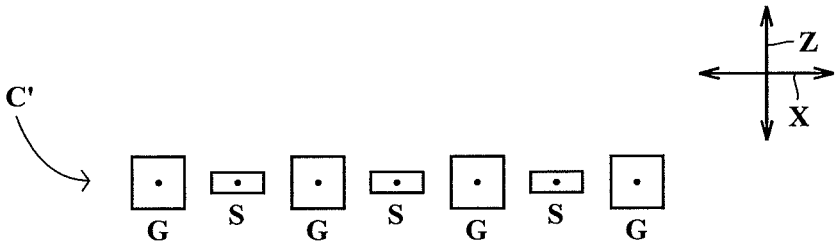
FIG. 8A is an explanatory view showing a design modification of a terminal group of the connector.
Figure 8B:
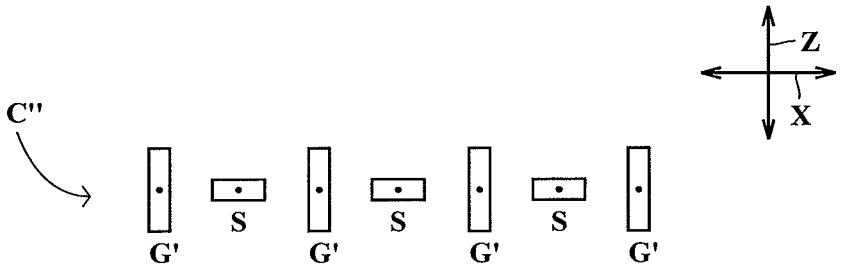
FIG. 8B is an explanatory view showing another design modification of the terminal group of the connector.

Alternatively, ground terminals may be arranged between a plurality of signal terminals for single-end or other transmission. The ground terminals may be arranged as shown in FIGS. 8A and 8B, wherein the ground terminals G or G' are disposed between signal terminals S for single-end or other transmission and on the outside of the signal terminals S at opposite ends in the first direction X. In other words, the ground terminals G or G' are arranged in spaced relation to each other along the first direction; and the signal terminals S are each disposed between adjacent two of the ground terminals G or G'. A reference character C' in FIG. 8A denotes a terminal group having the ground terminals G and the signal terminals S arrayed in a row along the first direction X in a body not shown. A reference character C" in FIG. 8B denotes a terminal group having the ground terminals G' and the signal terminals S arrayed in a row along the first direction X in a body not shown.

The signal terminals S may be of any shape extending in the second direction orthogonal to the first direction X. For example, the signal terminals S may be of similar shape to those of the first and second signal terminals 310S, 320S, 310S', 320S'.

The ground terminals G, G' may be modified in any manner on the following conditions. A first condition is that the ground terminals are electrically conductive members extending in the second direction. A second condition is that each ground terminal have a widthwise dimension in the first direction equal to or smaller than twice that of each signal terminal. A third condition is that each ground terminal, at least a portion thereof, has a larger thicknesswise dimension in the third direction than each signal terminal. Accordingly, as in the ground terminals G shown in FIG. 8A, each ground terminal between signal terminals may have substantially the same shape, except its the thicknesswise dimension, as each signal terminal. Alternatively, as in the ground terminals G' shown in FIG. 8B, each ground terminal between signal terminals may have a smaller widthwise dimension in the first direction X than each signal terminal. As to the third condition, it is preferable that each ground terminal, at least a portion thereof, has a thicknesswise dimension in the third direction equal to or larger than 1.5 times that of each signal terminal at a portion corresponding to the said portion of each ground terminal.

Moreover, the ground terminals G, G' and the signal terminal may be straight in shape and extend in the second direction, in which case the ground terminals G or G' may each have a larger thicknesswise dimension in the third direction from end to end than each signal terminal. Alternatively, each ground terminal G or G' may have a larger thicknesswise dimension in the third direction at its intermediate portion than the intermediate portion of each signal terminal. Furthermore, each ground terminal G or G' may have a similar configuration to those of the ground terminals 330G, 330G' or 330G".

Moreover, as shown in FIGS. 8A and 8B, the arrangement of ground terminals between signal terminals may be such that the centers of cross-sections in the third direction of the portions (parts) of the ground terminals G or G', which portions are each of larger thicknesswise dimension in the third direction than each signal terminal S, are located at substantially the same height position as the centers of cross-sections in the third direction of the portions of the signal terminals S corresponding to the said parts of the ground terminals. Alternatively, the centers of the ground terminals G or G' and the centers of the signal terminals S may be at different heights in the third direction.

The terminal group may be arrayed in a row in the body as described above, but the array may be modified as long as the first and second signal terminals (or the signal terminals) and the ground terminals are arrayed at least in a row in the body. That is, the terminal group may have a configuration in which the first and second signal terminals (or the signal terminals) and the ground terminals are arrayed in two or more rows in the body. The terminal group may have the pair of first signal terminals, the pair of second signal terminals, and the plurality of ground terminals as in the above-described embodiment. Alternatively, the terminal group may have a plurality of pairs of first signal terminals, a plurality of pairs of second signal terminals, and a plurality of ground terminals. In this case, some of the ground terminals may be arranged such that each ground terminal is disposed between each pair of first signal terminals and each pair of second signal terminals. Other ground terminals may be disposed on the outside of the contacts at opposite ends in the first direction of all the first and second signal terminals.

The materials, shapes, sizes, numbers, arrangements, etc. of the respective elements of the connector have been described by way of example only, and they may be modified in design in any manner as long as they provide similar functions. The connector of the invention may be a receptacle connector as in the embodiment, but it may be a plug connector. The first and second signal terminals are not limited to the use for transmitting high-speed differential signals as in the above-described embodiment. The first and second signal terminals and the signal terminals may be applicable to transmission of any kind of signals at any frequencies.

REFERENCE SIGNS LIST

100 body
110 main body
120 projection
200 shell
C terminal group
310S first signal terminal
311S intermediate portion
312S contact portion
313S bent portion
314S tail portion
320S second signal terminal
321S intermediate portion
322S contact portion
323S bent portion
324S tail portion
330G ground terminal
331G intermediate portion
332G contact portion
333G bent portion
334G tail portion
X first direction
Y second direction
Z third direction

The invention claimed is:

1. A connector comprising:

a body having insulation properties; and a terminal group arranged in a row in a first direction of the body, the terminal group including a pair of first signal terminals, a second signal terminal, and a ground terminal, wherein the pair of first signal terminals extends in a second direction orthogonal to the first direction and are adjacent to each other in the first direction, the second signal terminal extends in the second direction, the ground terminal extends in the second direction and is disposed between one of the first signal terminals and the second signal terminal, a widthwise dimension in the first direction of the ground terminal is less than twice that of each of the first signal terminals, and a thicknesswise dimension of at least a part of the ground terminal in a third direction orthogonal to the first and second directions is larger than that of each of the first and second signal terminals.

2. The connector according to claim 1, wherein the second terminal of the terminal group comprises a pair of second signal terminals adjacent to each other in the first direction, and the ground terminal is disposed between the one first signal terminal and one of the second signal terminals.

3. The connector according to claim 2, wherein the ground terminal comprises a plurality of ground terminals arranged in spaced relation to each other along the first direction, the pair of first signal terminals is interposed between adjacent two of the ground terminals, and the pair of second signal terminals is interposed between another adjacent two of the ground terminals.

4. The connector according to claim 2, wherein a center of a cross-section in the third direction of said part of the ground terminal is located substantially at the same height in the third direction as centers of cross-sections in the third direction of portions of the first and second signal terminals corresponding to said part of the ground terminal.

5. The connector according to claim 3, wherein a center of a cross-section in the third direction of said part of the ground terminal is located substantially at the same height in the third direction as centers of cross-sections in the third direction of portions of the first and second signal terminals corresponding to said part of the ground terminal.

6. The connector according to claim 1, wherein the widthwise dimension in the first direction of the ground terminal is smaller than the widthwise dimension in the first direction of at least one of the first and second signal terminals.

7. The connector according to claim 2, wherein the widthwise dimension in the first direction of the ground terminal is smaller than the widthwise dimension in the first direction of at least one of the first and second signal terminals.

8. The connector according to claim 1, wherein the ground terminal has a generally identical outer shape, except the thicknesswise dimension thereof, to that of at least one of the first and second signal terminals.

9. The connector according to claim 2, wherein the ground terminal has a generally identical outer shape, except the thicknesswise dimension thereof, to that of at least one of the first and second signal terminals.

10. The connector according to claim 1, wherein the first and second signal terminals are electrically conductive plates extending not only in the second direction but also in the first direction, and the ground terminal is a electrically conductive plate extending not only in the second direction but also in the third direction.

11. The connector according to claim 2, wherein the first and second signal terminals are electrically conductive plates extending not only in the second direction but also in the first direction, and the ground terminal is a electrically conductive plate extending not only in the second direction but also in the third direction.

12. The connector according to claim 1, wherein the thicknesswise dimension in the third direction of at least said part of the ground terminal is equal to or larger than 1.5 times that of each of the first and second signal terminals.

13. The connector according to claim 2, wherein the thicknesswise dimension in the third direction of at least said part of the ground terminal is equal to or larger than 1.5 times that of each of the first and second signal terminals.

14. A connector comprising:

a body having insulation properties; and a terminal group, the terminal group including a plurality of signal terminals and a ground terminal, the signal terminals and the ground terminal being arrayed in a row along a first direction in the body, wherein the signal terminals extend in a second direction orthogonal to the first direction, the ground terminal extends in the second direction and is disposed between two adjacent ones of the signal terminals, a widthwise dimension in the first direction of the ground terminal is less than twice that of each of the signal terminals, and a thicknesswise dimension of at least a part of the ground terminal in a third direction orthogonal to the first and second directions is larger than that of each of the signal terminals.

15. The connector according to claim 14, wherein the ground terminal comprises a plurality of ground terminals arranged in spaced relation to each other along the first direction, and the signal terminals are each interposed between adjacent two of the ground terminals.

16. The connector according to claim 14, wherein a center of a cross-section in the third direction of said part of the ground terminal is located substantially at the same height in the third direction as centers of cross-sections in the third direction of portions of the signal terminals corresponding to said part of the ground terminal.

17. The connector according to claim 14, wherein the widthwise dimension in the first direction of the ground terminal is smaller than that of each of the signal terminals.

18. The connector according to claim 14, wherein the ground terminal has a generally identical outer shape, except the thicknesswise dimension thereof, to that of each of the signal terminals.

19. The connector according to claim 14, wherein the signal terminals are electrically conductive plates extending not only in the second direction but also in the first direction, and the ground terminal is an electrically conductive plate extending not only in the second direction but also in the third direction.

20. The connector according to claim 14, wherein the thicknesswise dimension in the third direction of at least said part of the ground terminal is equal to or larger than 1.5 times that of each of the signal terminals.

* * * * *